US008820423B2

(12) United States Patent
Rousseau et al.

(10) Patent No.: US 8,820,423 B2
(45) Date of Patent: Sep. 2, 2014

(54) SELF SERVICING FIRE EXTINGUISHER WITH INTERNAL MIXING AND EXTERNAL $CO_2$ CHAMBER

(76) Inventors: Hector Rousseau, Riverside, CA (US); Randy Rousseau, Riverside, CA (US)

( * ) Notice: Subject to any disclaimer, the term of this patent is extended or adjusted under 35 U.S.C. 154(b) by 360 days.

(21) Appl. No.: 12/850,932

(22) Filed: Aug. 5, 2010

(65) Prior Publication Data

US 2012/0031631 A1 Feb. 9, 2012

(51) Int. Cl.

| | |
|---|---|
| ***A62C 11/00*** | (2006.01) |
| ***A62C 13/62*** | (2006.01) |
| ***A62C 13/66*** | (2006.01) |
| ***A62C 35/58*** | (2006.01) |

(52) U.S. Cl.
USPC ..... 169/71; 81/81; 81/83; 81/80; 81/30

(58) Field of Classification Search
CPC ..... A62C 11/00; A62C 13/62; A62C 13/66; A62C 35/58; A62C 13/60; A62C 19/00; A62C 25/00
USPC ..... 169/71, 81, 83, 88, 30
See application file for complete search history.

(56) References Cited

U.S. PATENT DOCUMENTS

| | | | | |
|---|---|---|---|---|
| 674,827 | A | | 5/1901 | Edmands |
| 907,029 | A | | 12/1908 | Giseke |
| 1,272,012 | A | | 7/1918 | Connor |
| 1,354,093 | A | | 9/1920 | Davidson |
| 1,733,724 | A | | 10/1929 | Downs |
| 1,790,231 | A | | 1/1931 | Dugas |
| 2,017,319 | A | | 10/1935 | McMullen |
| 2,067,829 | A | | 1/1937 | Dennel |
| 2,208,490 | A | * | 7/1940 | Axtell et al. ..... 169/88 |
| 2,430,470 | A | | 11/1947 | Keefe, Jr. |
| 2,489,339 | A | | 11/1949 | Stroop |
| 2,541,554 | A | | 2/1951 | Smith |
| 2,569,975 | A | | 10/1951 | Cone |
| 2,592,029 | A | | 4/1952 | Hansen |
| 2,785,759 | A | | 3/1957 | Fleming et al. |
| 3,149,677 | A | | 9/1964 | Blair |
| 3,255,824 | A | | 6/1966 | Rodgers |
| 3,618,669 | A | * | 11/1971 | Sachs ..... 169/76 |
| 3,650,329 | A | * | 3/1972 | Sachs ..... 169/85 |
| 3,713,493 | A | | 1/1973 | Hansen |
| 3,719,232 | A | | 3/1973 | Gubela |
| 3,858,659 | A | | 1/1975 | Fukushima |
| 4,372,394 | A | | 2/1983 | Allegri, Sr. |

(Continued)

FOREIGN PATENT DOCUMENTS

| | | |
|---|---|---|
| GB | 447936 | 5/1936 |

*Primary Examiner* — Justin Jonaitis
(74) *Attorney, Agent, or Firm* — Kirk A. Buhler; Buhler & Associates

(57) ABSTRACT

Improvements to a portable fire extinguisher are disclosed. The improvements allow for frequent and simpler untrained and automatic self-servicing of a fire extinguisher. The improvements include an anti-bridging mechanism that fluffs, mixes or stirs the powder within the chamber to keep it in a liquefied state. Additional improvements include a larger opening to more quickly fill and inspect the powder within the chamber. Another improvement includes the use of a $CO_2$ canister located external to the chamber to allow easier servicing or replacement of just the $CO_2$ canister as well as the ability to maintain the chamber in an un-pressurized condition, allows for non-HASMAT shipping. These features will extend the service intervals while maintaining the fire extinguisher in a ready condition.

3 Claims, 8 Drawing Sheets

(56) References Cited

U.S. PATENT DOCUMENTS

| | | | | |
|---|---|---|---|---|
| 4,505,336 | A | 3/1985 | Thevis et al. | |
| 4,567,948 | A | 2/1986 | Roznieck i | |
| 4,650,004 | A | 3/1987 | Wendling et al. | |
| 4,862,968 | A | 9/1989 | Woodman | |
| 5,676,190 | A * | 10/1997 | Matsumoto et al. | 169/74 |
| 6,189,624 | B1 | 2/2001 | James | |
| 6,378,740 | B1 | 4/2002 | Martin | |
| 6,527,058 | B1 | 3/2003 | Nerat | |
| 7,128,163 | B1 * | 10/2006 | Rousseau et al. | 169/77 |
| 7,318,484 | B2 * | 1/2008 | Rousseau et al. | 169/77 |
| 2004/0140373 | A1 * | 7/2004 | Joseph et al. | 239/379 |
| 2004/0166266 | A1 | 8/2004 | de Wit | |
| 2005/0060953 | A1 | 3/2005 | Altonen et al. | |

* cited by examiner

SELF SERVICING FIRE EXTINGUISHER WITH INTERNAL MIXING AND EXTERNAL $CO_2$ CHAMBER

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in portable fire extinguishers. More particularly, the present invention relates to a fire extinguisher that allows for external mixing, fluffing, actuating or stirring of the powder within the chamber to provide anti-bridging of the powder to keep it in a liquefied state, a larger opening in the chamber to allow easier filling of the chamber and a $CO_2$ canister that is located external to the extinguisher chamber.

2. Description of Related Art Including Information Disclosed Under 37 CFR 1.97 and 1.98

Most portable fire extinguishers are of a similar design where the fire extinguishing powder is contained in a pressurized chamber. Fire extinguishers of this type require scheduled maintenance because the powder within the chamber can settle and cake preventing it from being dispensed when needed. The pressure within the chamber may also leak over time and be insufficient to propel the powder out of the dispensing nozzle. A further limitation, based upon this design is due to the pressurized condition of the chamber, powder is placed into the chamber in a small opening in the top of the extinguisher. This scheduled maintenance allow moisture intrusion causing caking. Current extinguishers can only be service by trained certified technicians, and the certification is issued by the fire marshal for each state.

Current extinguishers are open to wear and tear because of the constant pressure and tear down process. When serviced they are fires into a recycling chamber and all the parts must be disassembled and cleaned. All the pressure rings must be replaced and every part must them be re-assembled with new powder being placed within the chamber prior to pressurizing the chamber. The servicing of current fire extinguishers often creates more wear and tear on the fire extinguisher than when it is used to extinguish a fire.

U.S. Pat. No. 6,189,624 issued to James on Feb. 20, 2001 and Japan Patent Number JP 9,225,056 issued to Yamazaki Tomoki on Sep. 2, 1997 discloses fire extinguishing mechanisms where the chamber is not continuously pressurized, and the pressurized chamber is a separate entity integrated within the chamber. While these patents disclose a separate pressurized canister, the canister is not located in a position that is easy to service, replace, or inspect. This minimizes the ability determine the charge level of the $CO_2$ cartridge.

U.S. Pat. No. 2,541,554 issued to C H Smith on Feb. 13, 1951 and Russian Patent Number RU 2,209,101 issued to Glavatski G. D. Et Al. Nov. 2, 2002 discloses a fire extinguisher with external $CO_2$ gas cartridge. In the case US '554 the $CO_2$ gas cartridge sits on top of the fire extinguisher chamber and is not integrated within the handle of the fire extinguisher. In the case of RU '101 the $CO_2$ gas cartridge is external to the extinguisher and is connected to the extinguisher with a pipe or hose. While both of these patents disclose a $CO_2$ cartridge that is external to the chamber, neither of them is placed in the handle to allow a configuration of the fire extinguisher that is simple to inspect and replace.

Due to the pressurized condition that exists with pressurized fire extinguishers, the opening where powder is placed into the extinguisher is limited due to the structural requirement to maintain pressure within the chamber at all times. The proposed application eliminates this need by providing an external $CO_2$ gas cartridge, thus allowing the chamber to exist in a normally un-pressurized condition. Because the chamber is not under pressure the top opening of the extinguisher can be enlarged to allow easier filling of the fire extinguisher with powder, or checking the amount and or condition of the powder within the chamber.

What is needed is a fire extinguisher with an external gas cartridge where the gas cartridge is located in the handle, a fluffer is accessible from outside the chamber, and the chamber has an enlarged top opening for filling the extinguisher. The proposed fire extinguisher provides this solution by providing a fire extinguisher with an external gas cartridge, external fluffer and large opening.

BRIEF SUMMARY OF THE INVENTION

It is an object of the fire extinguisher to eliminate the need for service personnel to enter secure areas. The extinguisher can have a higher level of service. Can be operated automatically "self-service" and or manually services by the owner or end user. This eliminates the need for non-employees to enter the privacy of business and government areas. This extinguisher can be operated, maintained, refilled and charged with no special training or equipment allowing for anyone who purchases it to have it function like any of the office equipment that is available to day like a copier, printer or water cooler. The proposed fire extinguisher is not required to be broken down when it has been fired.

The reduced outside servicing and maintenance of the fire extinguisher is ideal for placement of the fire extinguisher to be placement in secure areas. This will reduce or eliminate the possibility that a terrorist could utilize the fire extinguisher as a weapon, or use false identity as an extinguisher service person to gain access to a secure area.

It is an object of the fire extinguisher to provide a fire extinguisher with an external gas canister. The external canister allows the chamber to exist at or near ambient pressure that reduces the need to utilize a high strength chamber. The standard $CO_2$ cartridge that is used in other applications can be easily adapted to operate with the fire extinguisher. Since the $CO_2$ cartridge is external to the chamber it can be easily replaced or swapped without replacing the entire fire extinguisher. This provides a tremendous benefit when a large number of fire extinguishers need to be service at one time. The replaceable $CO_2$ cartridge can also be supplied with a replaceable seal rupturing device that ensures the rupturing device is sharp with each replaceable $CO_2$ cartridge.

It is another object of the fire extinguisher to provide a fire extinguisher with an externally accessible fluffing mechanism. The externally accessible fluffing mechanism promotes anti-bridging of the powder within the chamber to keep it fluffed, agitated, stirred or disturbed to prevent caking of the powder and keep the powder in a liquefied state so it is easier to spray the powder onto a fire. The fluffing is accomplished with paddles, flapper, chains rods or other mixing mechanisms located within the chamber.

It is an object of the fire extinguisher to provide a fire extinguisher that can be quickly opened and closed using a variety of quick opening and closing mechanisms. Often the fire extinguishing media can embed in the threads of the fire extinguisher and make unscrewing difficult. Sliding, locking, bayonet and other forms of securing the top to the bottom housing minimize or eliminate this problem.

It is still another object of the fire extinguisher to provide a fire extinguisher with an enlarged filling opening. The enlarged filling opening makes it easier and faster to fill and or empty the chamber. The top can also be easily removed to visually inspect the condition of the powder within the chamber.

It is still another object of the fire extinguisher to provide a fire extinguisher with tapered side walls. The tapered side walls allows the fire extinguishing media to loose when the fire extinguisher is inverted thereby allowing the fire extinguishing media to expand into the tapered portion of the fire extinguisher. The tapered sides and or the ends of the fire extinguisher may further have fingers or other features that break-up the fire extinguishing media when the extinguisher is rotated or inverted.

It is still another object of the fire extinguisher to provide have a quick opening and closing top housing thereby allowing a user to quickly open and refill the fire extinguisher. This also allows a fire fighter the load the desired fire extinguishing media based upon the type of fire.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
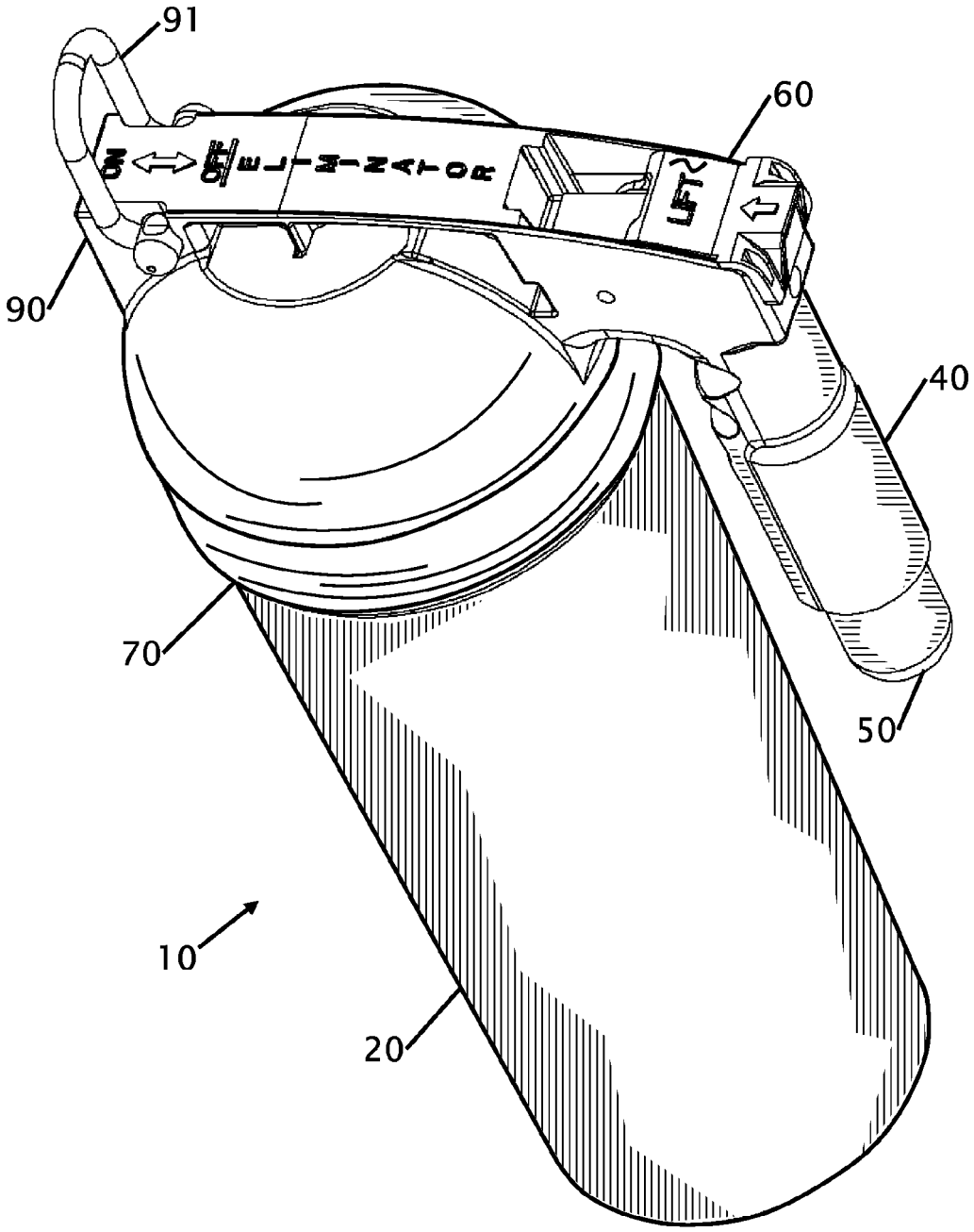
FIG. 1 shows an isometric view of a preferred embodiment of the improved fire extinguisher.

FIG. 1 shows an isometric view of a preferred embodiment of the improved fire extinguisher 10. The chamber 20 is substantially a cylindrical shape with a bottom and a top. In the preferred embodiment the chamber is made from a lightweight resilient material such as plastic, but the chamber could also be made of steel, brass, copper or aluminum. On the top of the chamber the fire extinguishing dispensing apparatus is provided. The top is screwed onto the chamber, but it could also be attached with a bayonet or latching mechanism. The lid fits on top of an enlarged opening 70 on the chamber to allow easier filling of the chamber 20 with fire retardant materials. A wall hanging mechanism can be incorporated into the top of the extinguisher, wrap around the body of the cylinder or fork the top of the extinguisher. A handle 40 allows the operator to hold the extinguisher in an upright orientation when it is being used. The fire extinguisher can also be stored and or transported in the upright orientation, but the upright orientation is not critical for the storage or operation of the extinguisher. Within the handle 40 a pressurized gas canister 50 is located. While in the preferred embodiment the pressurized gas canister is shown within the handle other locations such as within the top of the extinguisher or adjacent to the hose are contemplated.

The canister 50 consists essentially of a compressed gas cartridge, but canisters of different types of gas are possible that do not promote spreading of the fire. Because the gas within the canister is under high pressure or in a liquid state, a small canister of gas is required to expel the contents of the chamber 20. It is also contemplated that multiple gas canisters can be placed within the handle to accommodate a larger fire extinguisher without deviating from the inventive nature of the design. Gas canisters are available from a variety of sources and can be replaced or serviced without the need to service the entire fire extinguisher. The handle 40 provides some protection to the canister in the event the fire extinguisher is dropped or roughly handled. A trigger mechanism 60 opens the gas canister to pressurize the chamber and expel the fire extinguishing media into and out of the exit port or application nozzle 90. A control valve 91 opens and closes the exit port to prevent fire extinguishing powder from pouring out of the extinguisher when the trigger 60 is no longer being depressed. The path from the gas canister 50 to the application nozzle 90 is best shown and described in FIG. 2.

Figure 2:
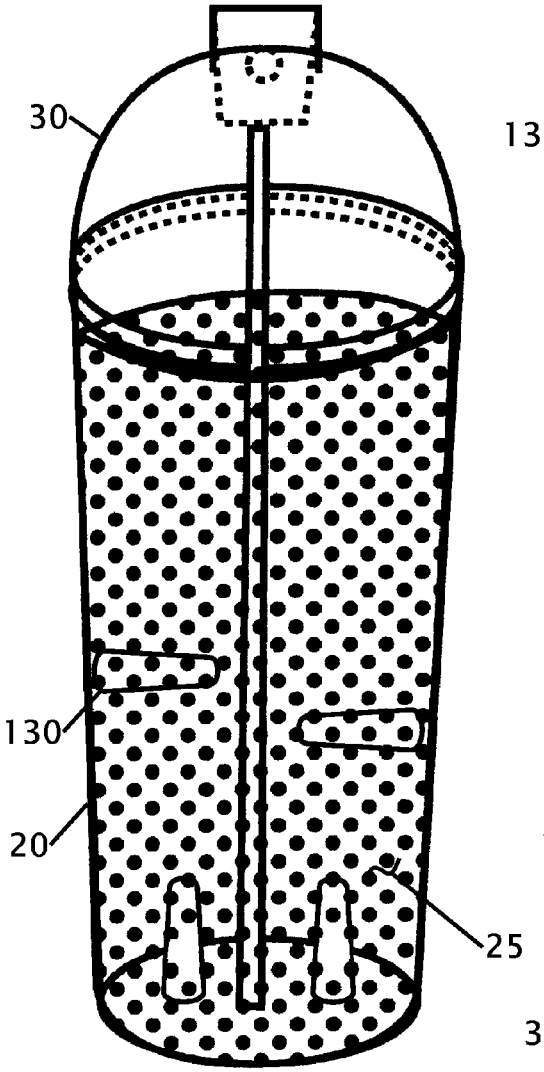
FIG. 2 shows a side sectional view of the fire extinguisher with tapered sides showing the fire extinguishing powder within the chamber.
Figure 3:
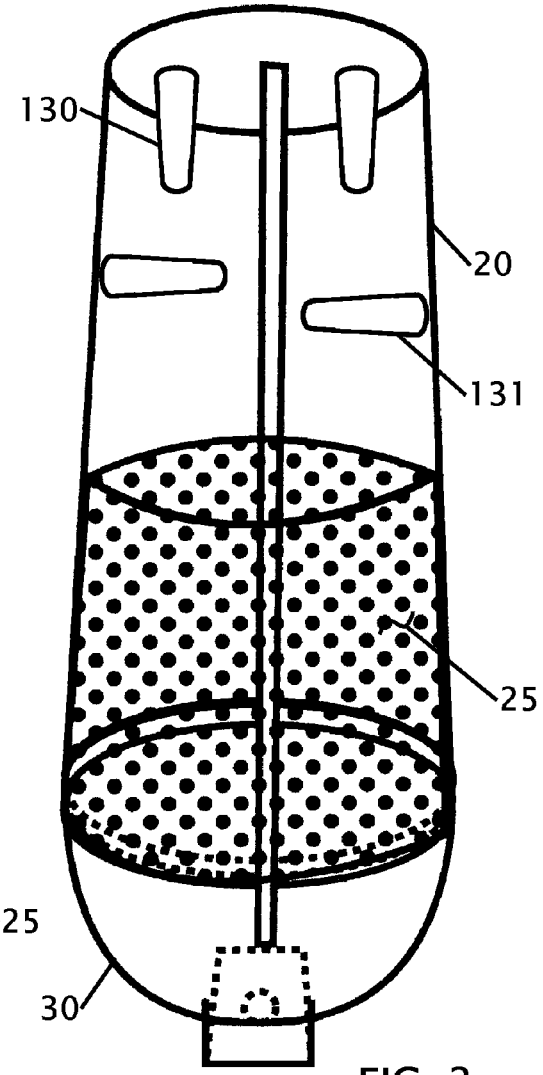
FIG. 3 shows a side sectional view of an inverted fire extinguisher with tapered sides showing the fire extinguishing powder within the chamber.
Figure 4A:
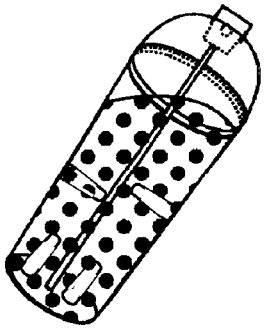
FIGS. 4A-4C show movement of the fire suppressing media within the tapered walls of the chamber as the chamber is rotated.
Figure 4B:
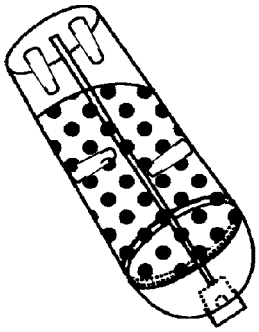
Figure 4C:
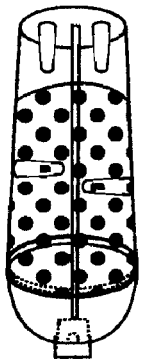

FIG. 2 shows a side sectional view of the fire extinguisher with tapered sides showing the fire extinguishing powder within the chamber. FIG. 3 shows a side sectional view of an inverted fire extinguisher with tapered sides showing the fire extinguishing powder within the chamber and FIGS. 4A-4C show movement of the fire suppressing media within the tapered walls of the chamber as the chamber is rotated. The tapered side walls 20 allows the fire extinguishing media 25 to loose when the fire extinguisher is inverted thereby allowing the fire extinguishing media to expand into the tapered portion of the fire extinguisher. The tapered sides and or the ends of the fire extinguisher may further have finger or blades 130, 131 or other features that break-up the fire extinguishing media when the extinguisher is rotated or inverted as shown in FIGS. 4A, 4B and 4C.

Figure 5:
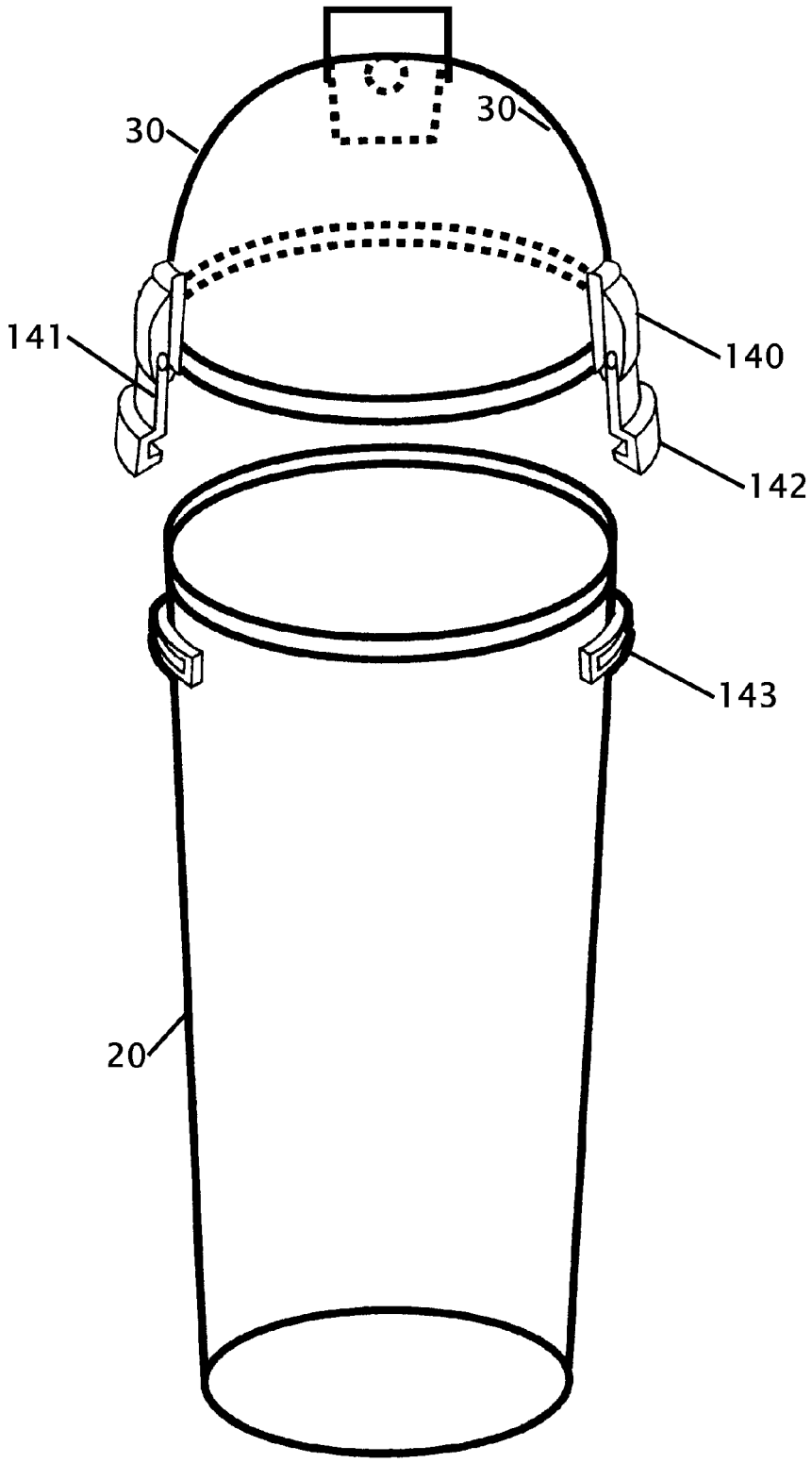
FIG. 5 shows a second preferred embodiment of a securing mechanism of the top to the chamber.

FIG. 5 shows a second preferred embodiment of a securing mechanism of the top to the chamber. The securing mechanism has ears 143 that exist on the lower chamber 20. The top housing 30 has an anchor 140 with a hasp 142 having an engaging strap 141 that engages in the ears 143. When the hasp 142 is engaged in the ears 143, the straps are pulled to lock the top housing 30 onto the chamber 20. While the figure shows two locking hasps it is contemplated that more than two can be utilized.

Figure 6:
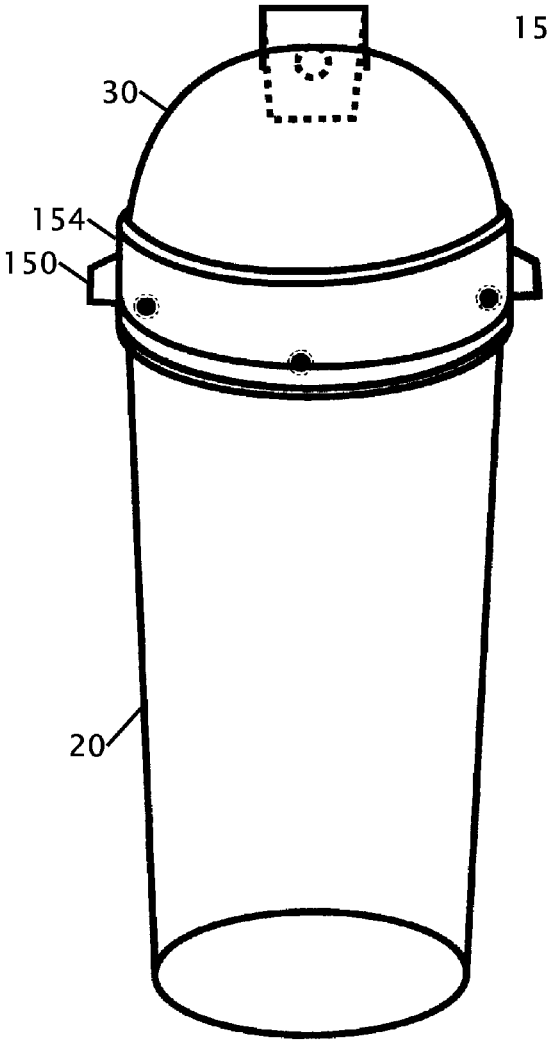
FIG. 6 shows a third preferred embodiment of a securing mechanism of the top to the chamber.
Figure 7:
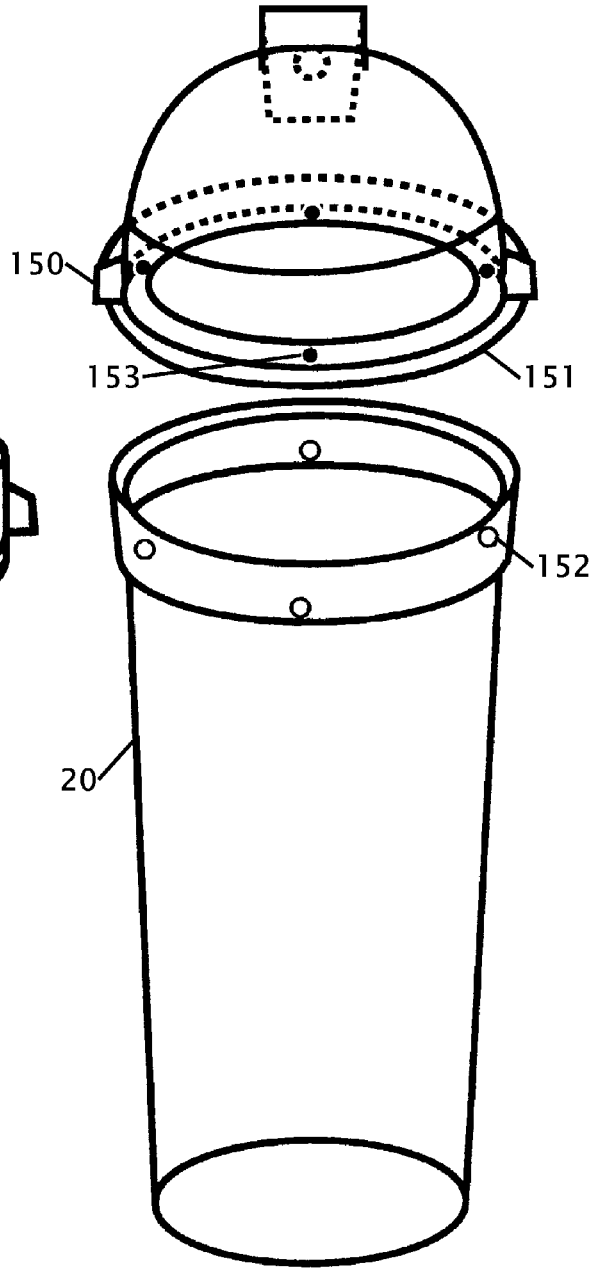
FIG. 7 shows the third preferred embodiment of a securing mechanism of the top to the chamber with the top removed.

FIG. 6 shows a third preferred embodiment of a securing mechanism of the top to the chamber and FIG. 7 shows the third preferred embodiment of a securing mechanism of the top to the chamber with the top removed. This embodiment uses a series of ball bearings 153 that lock into a series of holes 152. A ring 154 is rotated or lifted with ears 150 or by manual manipulation to unlock the ball bearings 153 from the holes 152. A lip 151 seats and seals the top 20 to the bottom 30 housing.

Figure 8:
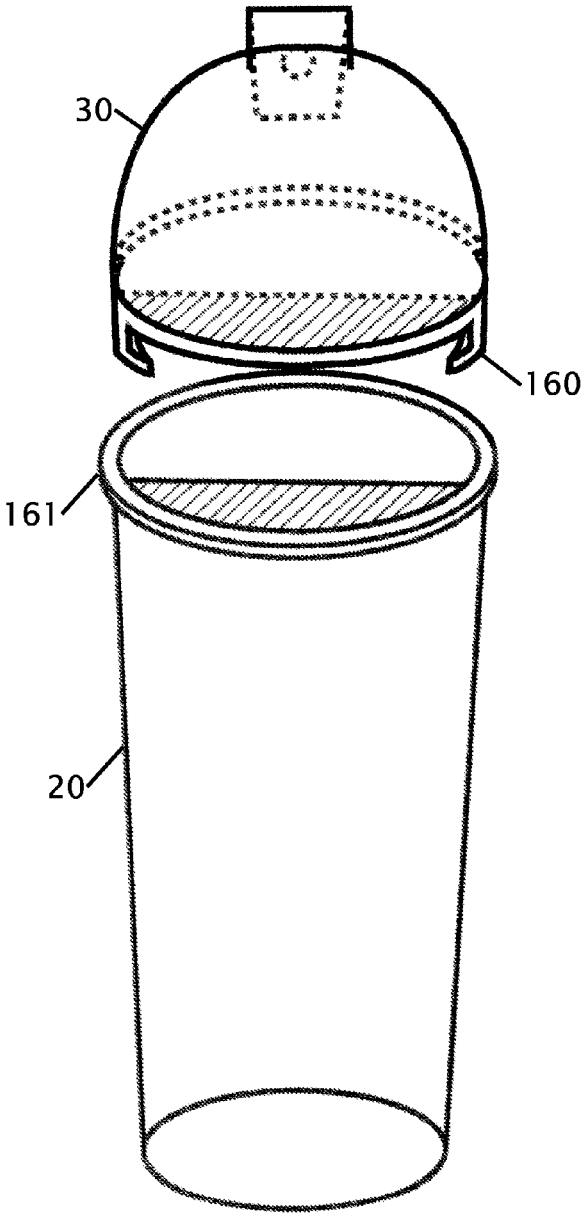
FIG. 8 shows a fourth preferred embodiment of a securing mechanism of the top to the chamber.
Figure 9A:
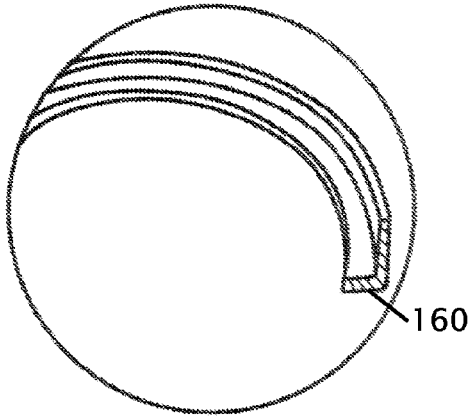
FIGS. 9A and 9B shows detailed views of the embodiment shown in FIG. 13.
Figure 9B:
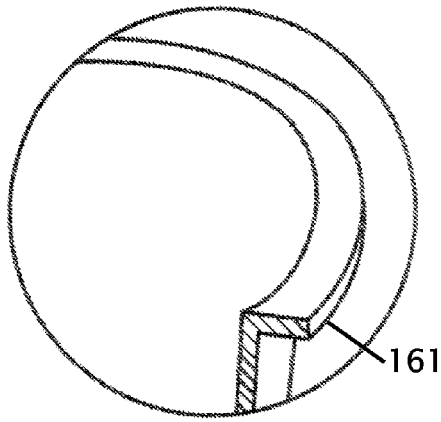

FIG. 8 shows a fourth preferred embodiment of a securing mechanism of the top to the chamber and FIGS. 9A and 9B shows detailed views of the embodiment shown in FIG. 8. In this embodiment the top housing 30 slides across the bottom housing 20. The top housing 30 has opposing lips 160 that engage onto a ridge 161 in the lower housing to lock the top housing 30 onto the bottom housing 20 when they are slid horizontally together.

Figure 10:
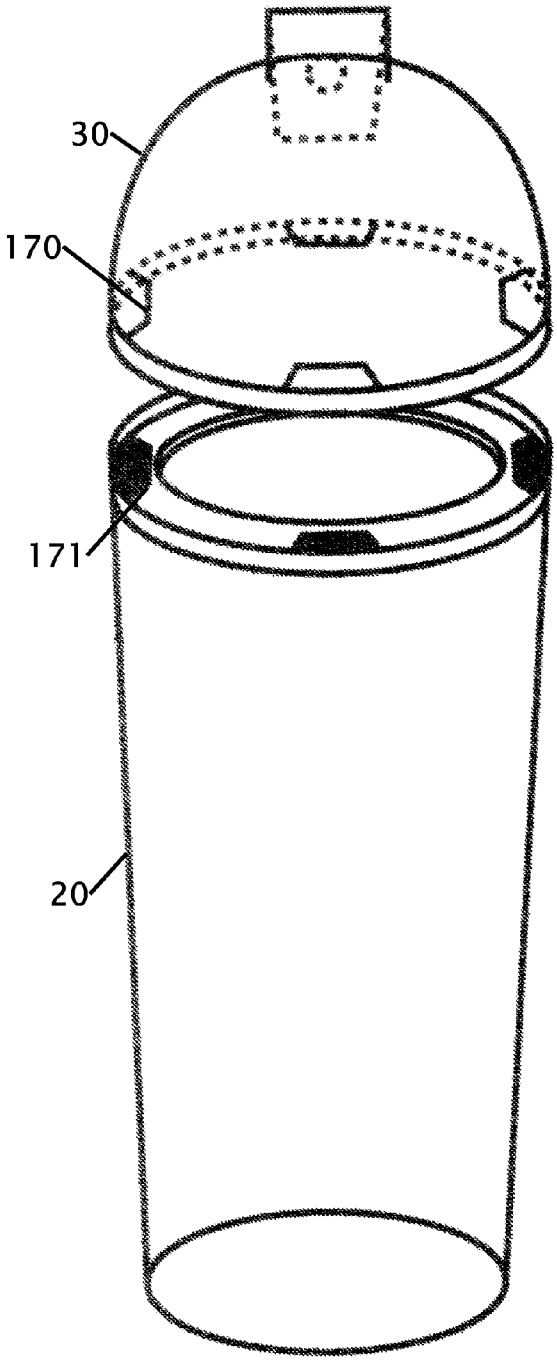
FIG. 10 shows a fourth preferred embodiment of a securing mechanism of the top to the chamber.
Figure 11A:
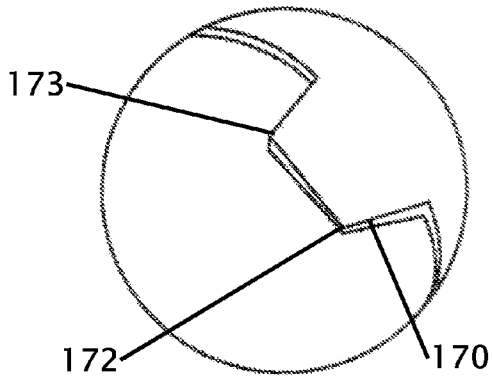
FIGS. 11A and 11B shows detailed views of the embodiment shown in FIG. 15.
Figure 11B:
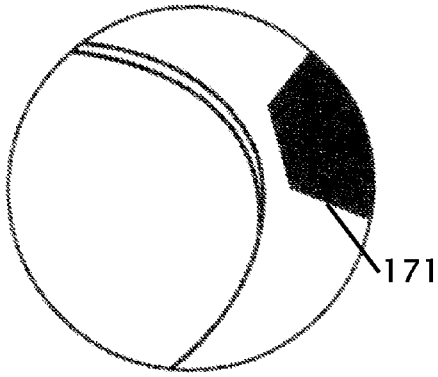

FIG. 10 shows a fourth preferred embodiment of a securing mechanism of the top to the chamber and FIGS. 11A and 11B shows detailed views of the embodiment shown in FIG. 10. In this embodiment the top housing 30 has a tab 170 where each tab 170 has a tapered front edge 172 with a wider back edge 173. The tab 170 drops into mating holes 171 located in the bottom housing 20. The tapered tab 170 pulls the top housing 30 down into the bottom housing 20.

Figure 12:
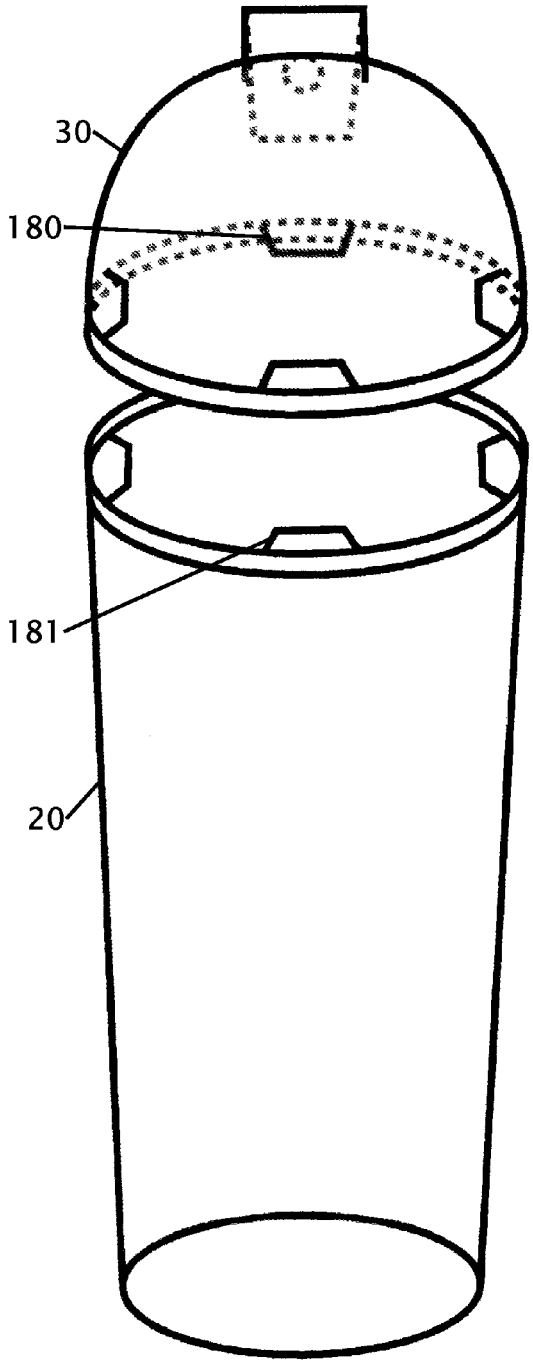
FIG. 12 shows a fourth preferred embodiment of a securing mechanism of the top to the chamber.
Figure 13A:
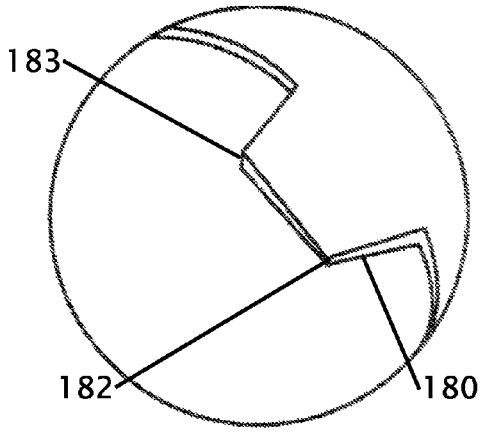
FIGS. 13A and 13B shows detailed views of the embodiment shown in FIG. 17.
Figure 13B:
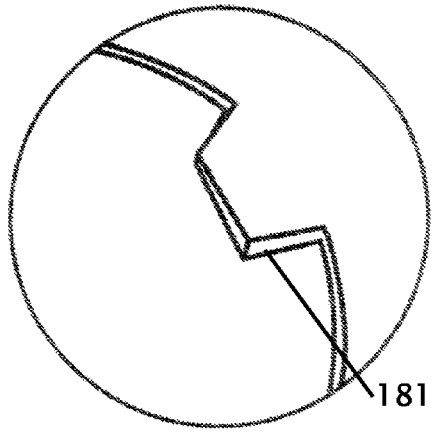

FIG. 12 shows a fourth preferred embodiment of a securing mechanism of the top to the chamber and FIGS. 13A and 13B shows detailed views of the embodiment shown in FIG. 12. In this embodiment the top housing 30 has a tab 180 where each tab 180 has a tapered front edge 182 with a wider back edge 183. The tab 180 engage with mating tabs 181 located in the bottom housing 20. The mating tabs 181 located in the bottom housing also are tapered. The tapered tab 180 pulls the top housing 30 down into the bottom housing 20.

Figure 15:
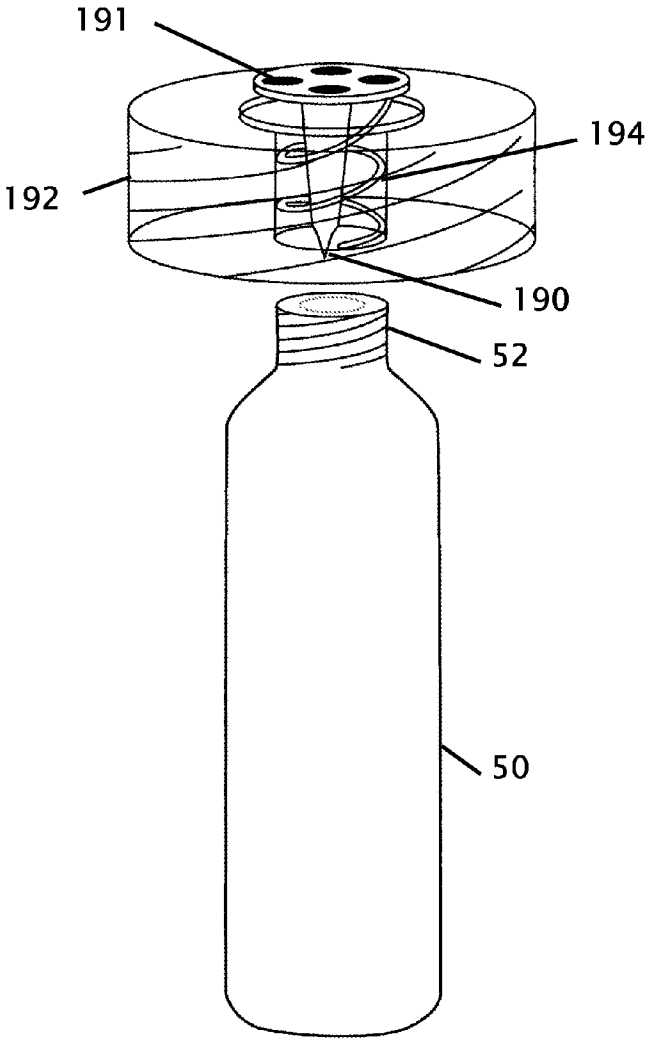
FIG. 15 shows a third preferred embodiment of the connection of the pressurized gas canister and the fire extinguisher.
Figure 14:
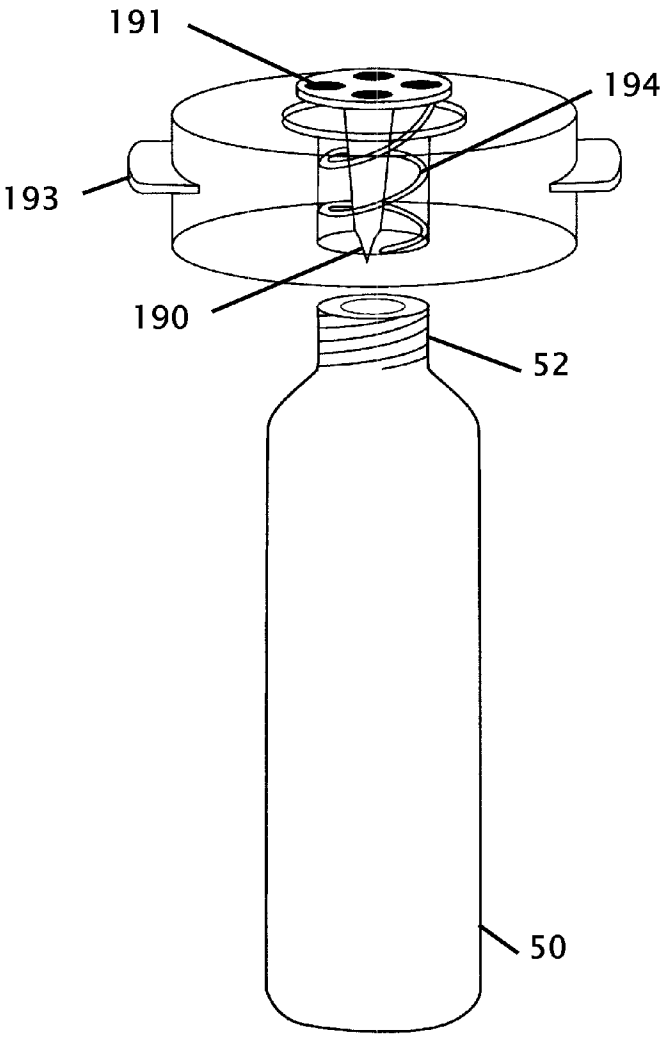
FIG. 14 shows a second preferred embodiment of the connection of the pressurized gas canister and the fire extinguisher.

FIG. 14 shows a second preferred embodiment of the connection of the pressurized gas canister and the fire extinguisher and FIG. 15 shows a third preferred embodiment of the connection of the pressurized gas canister and the fire extinguisher. In these figures the replaceable $CO_2$ cartridge 50 is supplied with a replaceable seal rupturing device that ensures the rupturing device is sharp with each replaceable $CO_2$ cartridge 50. The replaceable seal rupturing device is secured to the top of the replaceable $CO_2$ cartridge 50 using threads 52 or other mechanism that secures the replaceable $CO_2$ cartridge 50 to the replaceable seal rupturing device. The seal rupturing device is secured into the fire extinguisher with threads 192 as shown in FIG. 15, with engaging ears 193 as shown in FIG. 14 or by other means that holds the replaceable $CO_2$ cartridge 50 within the fire extinguisher.

The replaceable seal rupturing device has a pin 190 that ruptures the seal on the replaceable $CO_2$ cartridge 50. In the preferred embodiment the pin is hollow to allow the pressurized gas to pass through the pin 190. The opposing side of the pin 190 has a plurality of vent holes 191 that allows the gas within the cartridge to vent into the fire extinguisher. A spring 194 keeps the point of the pin 190 away from the seal and also lifts the pin 190 out of the hole that is made when the cartridge is ruptured.

Thus, specific embodiments of an improved fire extinguisher have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A portable fire extinguisher comprising:

a tapered cylindrical chamber having a bottom housing and a top housing wherein said bottom housing contains fire suppressing media, where said cylindrical chamber further includes at least one appendage internal to said tapered cylindrical chamber that conditions said fire suppression media within said tapered cylindrical chamber;

said at least one appendage is a finger or a blade that extends from an interior side wall of said tapered cylindrical chamber, and said bottom housing and said top housing are connected with a quick disconnect with at least two interlocking tabs, ball detents, or a hasps that allow said top housing to be completely removed and interchanged with said bottom housing or other bottom housings.

2. A portable fire extinguisher according to claim 1 in which said conditioning of said fire suppression media agitates, fluffs, turns, disturbers, stirs, ruffles, and or alters the condition of said fire suppression media to allow said fire suppression media to maintain a powder consistency.

3. A portable fire extinguisher according to claim 1 that further includes a pressurized gas canister located at least partially within the handle of the fire extinguisher.

* * * * *